United States Patent [19]

Booth-Cox

[11] Patent Number: 4,759,086

[45] Date of Patent: Jul. 26, 1988

[54] DISPOSABLE RECEPTACLE FOR BODILY WASTE

[76] Inventor: Charlotte A. Booth-Cox, 1909 Henry Ave., Middletown, Ohio 45042

[21] Appl. No.: 625,087

[22] Filed: Jun. 27, 1984

[51] Int. Cl.[4] ..... A61G 9/00

[52] U.S. Cl. ..... 4/451; 4/452

[58] Field of Search ..... 4/451–453, 4/456, 457, 445; 604/359, 375, 317, 319, 385.1, 358; 220/87; 383/109, 113; 119/95, 143, 1

[56] References Cited

U.S. PATENT DOCUMENTS

| | | | |
|---|---|---|---|
| 445,011 | 1/1891 | Cunningham | 4/456 |
| 569,922 | 10/1896 | Hutton | 4/456 |
| 2,798,636 | 7/1957 | Ketchledge | 220/87 X |
| 3,061,840 | 11/1962 | Presseisen | 4/456 X |
| 3,377,631 | 4/1968 | Whitney | 4/452 X |
| 3,475,767 | 11/1969 | Friesen et al. | 4/452 |
| 3,713,178 | 1/1973 | Mallette | 4/451 |
| 3,729,748 | 5/1973 | Perlman | 4/445 |
| 3,794,034 | 2/1974 | Jones | 604/375 X |
| 3,834,606 | 9/1974 | Andersson | 229/2.5 |
| 3,916,452 | 11/1975 | Alt | 4/445 |
| 3,927,825 | 12/1975 | Stearley | 383/113 X |
| 3,936,890 | 2/1976 | Oberstein | 4/452 |
| 3,939,502 | 2/1976 | Miller | 4/456 |
| 3,952,336 | 4/1976 | Kunter et al. | 4/456 X |
| 4,011,606 | 3/1977 | Scrafield et al. | 4/457 |
| 4,343,053 | 8/1982 | O'Connor | 4/452 |

FOREIGN PATENT DOCUMENTS

| | | | |
|---|---|---|---|
| 3216136 | 11/1983 | Fed. Rep. of Germany | 4/451 |
| 2108381 | 5/1983 | United Kingdom | 4/451 |

*Primary Examiner*—Henry J. Recla
*Assistant Examiner*—L. J. Peters

[57] ABSTRACT

A disposable receptacle for receiving bodily waste, comprising of a fluid permeable inner layer and in impermeable outer layer, with an absorbant outer layer, with an absorbant layer in between, and a rim portion with fastening means to attach the receptacle so it depends downwardly through the hole in a bed pan support or toilet trainer.

20 Claims, 1 Drawing Sheet

DISPOSABLE RECEPTACLE FOR BODILY WASTE

BACKGROUND OF THE INVENTION

1. Field of the Invention

This invention relates to a disposable receptacle for receiving bodily waste material so that it can be disposed of easily and in a sanitary manner. In particular, it relates to receptacles for receiving the waste material from small children who are undergoing toilet training.

2. The Prior Art

Disposable diapers are disclosed in U.S. Pat. Nos. 3,848,594 and 4,041,951. Such diapers have a thin, soft, waterproof outer sheet and a non-wicking, water-permeable inner sheet joined to the outer sheet around the perimeter thereof, or adjacent to the perimeter. The two sheets thus form a generally rectangular envelope, and a layer of fluffy, water adsorbent material is held within the envelope. The inner sheet may have pleats formed in it, and the outer sheet may have an elastic strand captivated by an inwardly turned edge portion of the outer sheet, the purpose of the pleats and the elastic strand being to cause the diaper to have a shape that is somewhat form-fitting on an infant.

The fact that the inner sheet, or film, is non-wicking but water-permeable means that urine and even fecal moisture will pass through it to be taken up by the water-adsorbent material. The fluid will not be retained by the water-permeable material in sufficient quantity to feel wet to the infant.

However, diapers of the type just described are not arranged as sacks joined together to form a united structure nor does the diaper have an outwardly extending rim with fastening means to attach the rim to a support means, such as a child's training chair.

OBJECTS AND SUMMARY OF THE INVENTION

It is an object of the invention to provide a receptacle capable of receiving bodily waste material to allow the material to be disposed of neatly and easily.

Another object is to make it more comfortable for a child to sit on a toilet-training chair than is presently the case with respect to chairs not provided with such receptacles, whereby the child will enter more willingly into the toilet-training routine.

A further object is to control disagreeable odors and procedures associated with toilet-training structures at the present time and thereby make toilet training of small children less onerous for other members of the household.

Still further objects will be apparent from the following specification and the accompanying drawings.

In accordance with this invention, a receptacle is formed that basically comprises two sacks, one inside the other. The outer sack is formed of soft plastic material such as the waterproof outer sheet of a disposable diaper. The inner sack is formed of water-permeable material, and its edge may or may not extend all the way to the edge of the waterproof outer material. The two sacks are joined together so that they will not fall apart without a specific effort's being made to separate them, and between the two sacks, or at least between their respective bottom regions, is water-adsorbent material.

The rim of the united structure may be formed of the rim of either or both sacks and is provided with fastening means to hold it in place on a suitable support, such as a toilet-training chair. Preferably the rim has an annular pad that forms a soft seat on which a small child can sit confortably, thereby making it easier for the child to be willing to sit there long enough to produce the desired results of a toilet-training session.

The bottom and side regions of the united structure extend downwardly through the hole in a toilet-training chair, and deodorizing material is located within the combined sacks to control any odors emenating from bodily waste eliminated by the child. Preferably the deodorizing material is normally in a dry condition, such as powder or crystals adsorbed on the surface of the myriad fibers making up the water-adsorbent material, and is activated by fluid from the child to produce the deodorizing effect.

After being used, the receptacle can be gathered up by unfastening its rim and can be disposed of in the same manner as a disposable diaper. Unlike the usual rigid receptacle used in toilet training, it is not necessary to spend any time getting the disposable receptacle of this invention ready to be used again. Because of the deodorizing material the odor usually associated with getting a rigid receptacle ready for its next usage is substantially reduced or even eliminated, thereby making the task much less onerous.

DETAILED DESCRIPTION OF THE INVENTION

Figure 1:
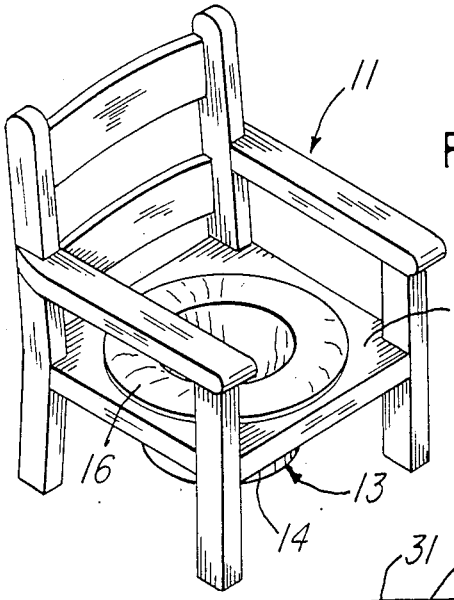
FIG. 1 is a perspective view of a toilet-training chair to which has been fastened a disposable receptacle of the type described herein.

The chair 11 in FIG. 1 is a typical chair used for toilet training of small children and has a seat 12 with a central hole in it. Typically such chairs have a slide structure under their seats to receive a rigid cup, but no such slide structure is required when the chair 11 is used with a disposable receptacle 13 according to this invention. The receptacle 13 shown in FIG. 1 comprises a sack portion 14 and an outwardly extending rim 16. The sack portion extends through the hole in the seat 12 and the perimeter of the hole is covered by the rim 16.

Preferably the sack portion substantially fills the hole in the seat 12 and would not fall through the hole prior to being used, but it is not necessary that the fit be a close one: it may be somewhat larger or even somewhat smaller. In any event the weight of waste material deposited in the receptacle 13 by a child would tend to pull the rim 16 down through the opening in the seat, and in order to prevent this the rim is fastened to the chair that supports the receptacle. Any suitable fastening means, such as snaps, strings, elastic bands or adhesive material may be used, but it is extremely important to minimize the cost of the receptacle and to make it as easy as possible to use it with any existing chair 11, and both of those results are more easily attained with adhesive material than with any of the other fastening means. Specifically, a layer of pressure-sensitive adhesive on the outer surface of the rim 16 can be used to hold the receptacle 13 in place.

Figure 2:
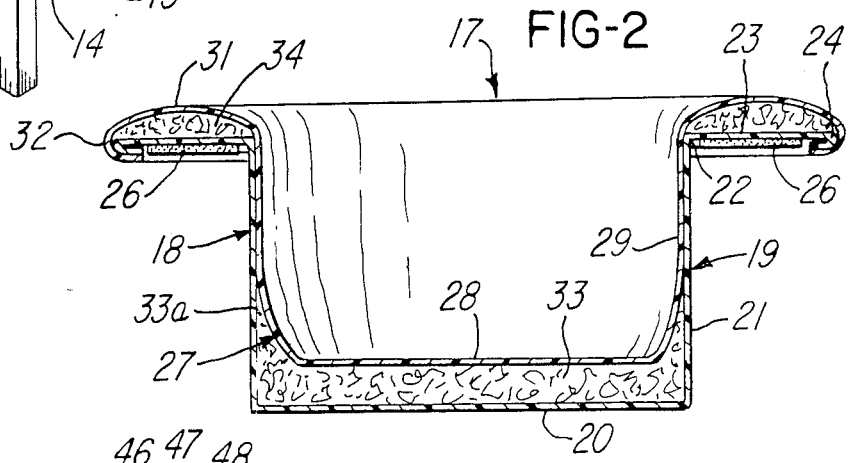
FIG. 2 is a cross-sectional view of one embodiment of the disposable receptacle of this invention.

FIG. 2 shows a disposable receptacle 17 in cross section. It includes an outer layer 18 formed into a sack 19 that has a bottom region 20. The bottom region is shown as being flat, although in reality the softness of the receptacle would allow it to take any shape. The layer 18 is a thin sheet of soft material, such as waterproof polyethylene. In the idealized structure shown in FIG. 2, the polyethylene material that forms the bottom region 20 curves upwardly at its perimeter to form a cylindrical side regions 21 and then, at the upper edge 22 of the side region 21, outwardly to form a generally radial annular flange, or rim, 23. The outermost edge of the flange is shown as having been turned back on itself to present a rounded outer perimeter 24, even though the polyethylene material is so soft that there is virtually no chance that even the die cut edge of it can cut a child. An annular ring 26 of pressure-sensitive adhesive is coated on the under surface of the rim 23, that is, on the surface that faces in the same direction that the sack 19 extends from the rim 23.

Inside the sack 19 and more or less congruent with it is a second sack 27 of water-permeable material, such as a thin sheet of non-woven cellulose or perforated or porous polyethylene. Like the outer sack 19, the inner sack 27 has a bottom region 28, a more or less cylindrical side region 29, and an outwardly extending rim 31 that is also turned under, like the rim 23, to present a wounded outer perimeter 32.

The bottom regions 20 and 28 are spaced apart to hold water-adsorbent material 33, such as comminuted cellulose known as air felt. It will be noted that the water-adsorbent material does not extend all the way up between the side regions 21 and 29 but stops at an intermediate location 33*a* well below the rims 23 and 31. The reason is that liquid passes through the material that forms the inner sack 27 and is held by the surfaces that make up the infinitesmal particles of the material 33, and it is not desirable that the liquid follow the material 33 up to the rims 23 and 31. If it did, it would wet the child using the receptacle 17, and such wetness would be directly contrary to the effect sought in toilet training. In the embodiment in FIG. 2 the material that forms the inner sack 27 is porous, or permeable to liquid, but it should not have wicking properties. In fact, it should be hydrophobic so as to repel water, and it can be made so by its nature or by treating it with materials that make it so. For example, if the material of which the sack 27 is formed is porous polyethylene, it is inherently hydrophobic. Other materials, such as non-woven cellulose may not be hydrophobic but may be treated with oil to make them so.

It is well known that all materials that are to come into contact, or might come into contact, with a baby or small child must be absolutely safe. Thus, it would be appropriate to make the receptacle 17 out of materials that have already been established as safe for use in a disposable diaper, although it is to be understood that other materials may be perfectly satisfactory and may be used instead. The invention is not limited to specific materials.

Between the rim 23 and the rim 31 is an annular ring 34 of soft material to make the seat as comfortable as possible. By making the ring 34 of water-adsorbent material, such as the material 33, the annular cushion can be made to adsorb any perspiration from the child. Such perspiration might occur during warm, humid days in the summer and would be likely to make the child sitting on the surface of the rim 31 uncomfortable. Since the rim 31 is water permeable and even hydrophobic, any perspiration from the child would pass through the rim 31 and be adsorbed in the ring 34. While the moisture would remain close to the child, the effect would at least be more comfortable for the child than if the child were forced to sit on a seat that is not only hard but impervious to moisture. I have found by actual experimentation that children are willing to sit longer on the padded seat of the receptacle of this invention than on standard, hard seats. Such extended time on the seat is more likely to result in the action desired of the child than in the case when the child is forced to sit on a hard, uncomfortable seat. Since the receptacle is not intended to stay on the supporting seat long, the fact that the soft ring 34 may get wet with perspiration or otherwise creates no problem. On the other hand, one reason seats of the type commonly in use at the present time are made hard is to prevent their soaking up any liquid. Permeable padding material on such seats could become unpleasant and even medically dangerous by the accretion of mold, bacteria, and the like in moisture in the padding material.

Figure 3:
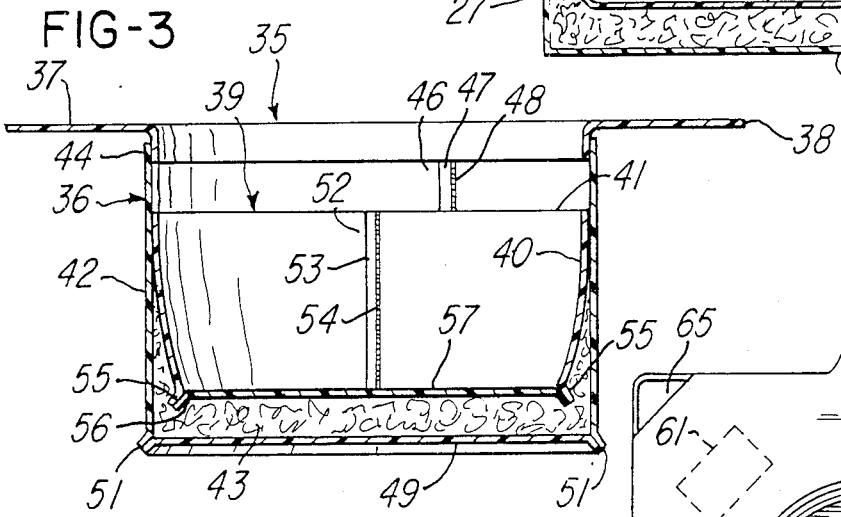
FIG. 3 is a cross-sectional view of a second embodiment of the disposable receptacle of this invention.

FIG. 3 shows a modified receptacle 35 that has an outer sack 36 with only a plain rim 37 but no padded ring of the type shown in FIG. 2. In addition, the perimeter 38 of the rim 37 is not turned under, and an inner sack 39 is provided that has no rim. Instead, the side region 40 of the inner sack terminates at an edge attached by glue or any other suitable means to the side region 42 of the outer sack 36. As in the embodiment in FIG. 2, the outer sack is made of waterproof material and the inner sack is of water-permeable material and there is a quantity of water-adsorbent material 43 between the bottom regions of the two sacks. Since the water-permeable material of the inner sack 39 does not even extend up to the rim 37 of the outer sack, no liquid that falls to the bottom of the united sack structure can rise into contact with the child, even if the material of which the inner sack 39 is made has a wicking property.

The outer sack 36 can be molded as a one-piece unit or it can be formed by joining the annular rim 37 to the edge 44 of a separate piece of waterproof material that forms the side region 42. The side region can be formed as an extruded tube or it can be formed by sealing opposite edges 46 and 47 together, as by a heat-sealed seam 48. The bottom region 49, which may have a polygonal contour instead of a round one, is sealed to the side region 42 along a seam 51 that extends along the entire length of the contour.

The inner sack 39 may likewise be made up of separate panels of water-permeable material glued or otherwise joined together. Opposite edges 52 and 53 of a rectangular or other-shaped piece of material can be glued or otherwise joined together along a seam 54, and one edge of the resulting generally tubular side region 40 can be attached along a seam 55 to the perimenter 56 of a piece of water-permeable material that forms the bottom region 57 of the inner sack 39.

Figure 4:
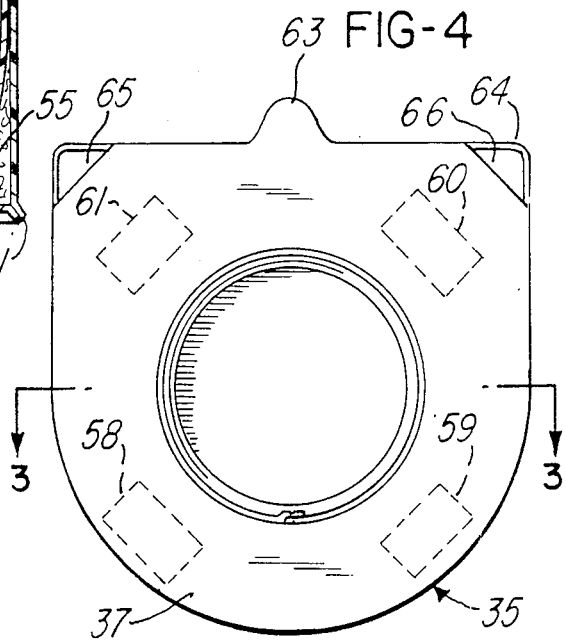
FIG. 4 is a plan view of the receptacle shown in FIG. 3.

FIG. 4 shows the rim 37 of the receptacle 35 of FIG. 3. Although the rim is generally annular, its inner and outer perimenters are not precisely circular. In fact, the embodiment in FIG. 4 includes several contour arrangements. At selected limited areas 58–61, which are on the reverse surface of the rim 37 as indicated by the dotted contours of these areas, the rim has patches of pressure-sensitive adhesive to hold it in place on a training chair. While the entire reverse surface of the rim 37 might have an annular ring of pressure-sensitive adhesive, limited areas are sufficient.

Furthermore, parts of the rim 37 that are not cemented to the supporting seat provide areas that may be easily grasped to separate the receptacle 35 from the seat when the receptacle is to be disposed of. Alternatively, the rim 37 may be provided with one or more tabs, such as the tab 63, for the same purpose.

A still further alternative is to join an elastic strand 64 to the perimeter of the rim 37. The strand is free of the rim material at regions 65 and 66 to allow the strand to be grasped and stretched over projections on the chair. The projections would have to be in regions, such as corners of the chair, where they could not hurt the child, and even when so located, they should be safely rounded. Alternatively, the strand 64 could be looped over corners of the seat if the corners project outwardly far enough.

While the receptacles have been described as being suitable for toilet-training small children, the same receptacle in larger size can be used for larger children who, for some reason cannot use a standard toilet, and it can also be used by incontinent adults or by older children or adults whose fecal matter must be analyzed without having been contaminated from any other source.

What is claimed is:

1. A flexible, disposable human-waste receptacle to be removably attached to and supported by support means comprising a seat with an opening therein, the receptacle comprising:

(a) flexible sack means comprising:

(i) a bottom portion comprising an outer, waterproof layer and an inner, water-permeable layer forming, with the outer layer, a liquid-receiving enclosure, (ii) a side portion extending from the bottom portion and comprising a waterproof side layer forming, with the bottom portion, substantially watertight holding means for human waste material, the inner, water-permeable layer being attached to the substantially watertight holding means, and (iii) a rim portion extending outwardly from the side portion, and including means for securing said rim portion over said seat adjacent the opening in said seat, whereby the side and bottom portions depend from the rim portion downwardly through the opening in the seat when the receptacle is in use to receive human waste; and (b) liquid-adsorbent means held in the liquid-receiving enclosure to retain liquid waste material that passes through the water-permeable layer into the enclosure.

2. The receptacle of claim 1 in which the rim portion is an integral outward extension of the edge of the side portion remote from the bottom portion.

3. The receptacle of claim 1 in which the outermost part of the rim portion is folded back on itself, the surface of the rim facing the bottom portion of the sack means comprising a layer of pressure-sensitive adhesive thereon, and the surface of the rim portion facing in the opposite direction being free of adhesive.

4. The receptacle of claim 1 in which the rim portion comprises an annular padded ring.

5. The receptacle of claim 1 comprising, in addition, attachment means to attach the rim portion to the support means.

6. The receptacle of claim 5 in which the attachment means comprises pressure-sensitive adhesive means.

7. The receptacle of claim 6 in which the pressure-sensitive adhesive means comprises a layer of pressure-sensitive adhesive on the lower surface of the rim portion facing away from the user sitting on the upper surface of the rim portion.

8. The receptacle of claim 7 in which the layer of pressure-sensitive adhesive is an annular ring thereof.

9. The receptacle of claim 5 in which the attachment means comprises at least one patch of pressure-sensitive adhesive to attach the rim portion to the seat.

10. The receptacle of claim 5 in which the attachment means comprises snap means.

11. The receptacle of claim 5 in which the attachment means comprises an elastic strand held at the perimeter of the rim portion.

12. The receptacle of claim 1 in which the waterproof side layer is formed as a seamless tube.

13. The receptacle of claim 1 in which the waterproof side layer comprises sheet means having opposite edges joined together to form a generally tubular member.

14. A flexible, disposable receptacle for a child's toilet-training seat that has a hole in it through which part of the receptacle can depend, said receptacle comprising:

(a) first, soft, flexible, waterproof sheet means forming a substantially watertight sack comprising a first bottom portion and a generally tubular side portion extending upwardly from the bottom portion, the bottom portion and the generally tubular side portion fitting through the hole in the toilet-training seat;

(b) second, soft, flexible, water-permeable sheet means forming second bottom and side portions within the substantially watertight sack and attached thereto to form, therewith, a united sack structure comprising an enclosure between the said first bottom portion and the second bottom portion;

(c) soft, water-adsorbent material retained within the enclosure between the bottom portions; and (d) holding means to hold the united sack structure to allow the united sack structure to depend below the hole in the toilet-training seat, the holding means comprising:

(i) a rim portion to rest on the toilet-training seat and comprisihng a part of the first sheet means extending outwardly from the united sack structure, and (ii) fastening means to fasten the rim portion to the toilet-training seat.

15. The receptacle of claim 14 in which the second soft sheet means is a non-wicking material.

16. The receptacle of claim 15 in which the second side portion comprises an uppermost edge that extends only part of the way up the generally tubular side portion to a location below the rim portion.

17. The receptacle of claim 14 in which the rim portion comprises an integral part of the first soft sheet means extending outwardly from the generally tubular side portion and underlying the outwardly extending second soft sheet means.

18. A flexible, disposable, human-waste receptacle to be removably attached to and supported by suport means comprising a seat with an opening therein, the receptacle comprising:

(a) a soft, outwardly extending portion to rest on an upper surface of the seat the outwardly extending rim portion comprising an outer edge and an inner edge;

(b) attachment means to attach the outwardly extending portion to the support means;

(c) flexible sack means joined to the outwardly extending portion to depend therefrom within the opening when the outwardly extending portion is in place on the seat and outwardly of the opening, the sack means having an inwardly directed wall surface and comprising:

(i) a waterproof bottom portion, and (ii) a generally tubular waterproof side portion extending from the bottom portion at least substantially to the inner edge of the outwardly extending portion;

(d) soft, liquid-permeable sheet material within the sack means and attached to the inwardly directed wall surface; and (e) liquid-adsorbent means contained between the liquid-permeable material and the waterproof bottom portion and spaced below the outwardly extending portion.

19. The receptacle of claim 18 in which the soft, outwardly extending portion is an annular ring formed separately from the flexible sack means, the inner perimeter of the annular ring being attached to the uppermost part of the flexible sack means.

20. The receptacle of claim 18 in which the outer edge of the soft, liquid-permeable sheet material is attached along a band that extends around the inwardly directed wall surface of the sack means to form, between the soft, liquid-permeable sheet material and the waterproof bottom portion of the flexible sack means, an enclosure, the liquid-adsorbent means being a soft material within the enclosure.

* * * * *